United States Patent [19]

Gillespie et al.

[11] 4,137,148

[45] Jan. 30, 1979

[54] MANUFACTURE OF SPECIALTY OILS

[75] Inventors: Bernard M. Gillespie, Pitman; Michael S. Sarli, Haddonfield; Kenneth W. Smith, Woodbury, all of N.J.

[73] Assignee: Mobil Oil Corporation, New York, N.Y.

[21] Appl. No.: 817,309

[22] Filed: Jul. 20, 1977

[51] Int. Cl.[2] ..... C10G 21/00; C10G 37/06

[52] U.S. Cl. ..... 208/87; 208/14; 208/111

[58] Field of Search ..... 208/14, 58, 87, 111, 208/97

[56] References Cited

U.S. PATENT DOCUMENTS

| | | | |
|---|---|---|---|
| 3,438,887 | 4/1969 | Morris et al. | 208/87 |
| 3,627,673 | 12/1971 | Sproule et al. | 208/211 |
| 3,894,938 | 7/1975 | Gorring et al. | 208/97 |
| 3,956,102 | 5/1976 | Chen et al. | 208/111 |

*Primary Examiner*—Herbert Levine

*Attorney, Agent, or Firm*—Charles A. Huggett; Vincent J. Frilette

[57] ABSTRACT

Specialty oils of very low pour point and excellent stability, such as transformer oils and refrigerator oils, are produced from waxy crude distillates by solvent refining, catalytic dewaxing over a zeolite catalyst in the nature of zeolite ZSM-5 and hydrotreating.

11 Claims, No Drawings

MANUFACTURE OF SPECIALTY OILS

FIELD OF THE INVENTION

The invention is concerned with manufacture of high grade viscous oil products from crude petroleum fractions and is particularly directed to the preparation of very low pour point specialty oils, such as electrical insulating oils and refrigerator oils, from crude stocks of high wax content, commonly classified as "wax base" as compared with the "naphthenic base" crudes. The latter are relatively lean in straight chain paraffins and yield viscous fractions by distillation which inherently possess low pour points. The invention is typified by a process for preparation of a transformer oil and also a refrigerator oil and is aptly considered with reference to the critical properties required of such oils.

BACKGROUND OF THE INVENTION

Electric power transformers are commonly filled with an oil which serves as a dielectric and as a heat transfer medium. Such oils must be very stable, i.e. chemically inert, in order that physical and electric properties of the oil shall not change in service. They must also be capable of free flow at low temperatures to perform the heat exchange function and also to disperse any degradation products which may arise from corona discharge within the transformer. For like reasons, the oil must be of low or moderate viscosity. Flash and fire points are also required properties in order that a temporary rise in temperature of the equipment shall not create an undue risk of fire.

High flash and fire points are achieved by employing petroleum fractions of high boiling point. But, in general, higher boiling point cuts are of higher viscosity. The compromise to achieve acceptable flash and fire points and acceptable viscosity results in selection of fractions within the boiling range of about 450°-1050° F., the range in which are found the straight and slightly branched paraffins which solidify at temperatures such as to cause the total fraction to fail the cloud point and pour point test specifications for transformer oils.

For the reasons stated it has been the practice of the petroleum refining industry to prepare transformer oils from naphthenic base crude fractions of suitable boiling range. The cost of dewaxing other crudes to the low pour point required of transformer oil by the conventional solvent dewaxing equipment presently available in refineries is so high as to be impracticable. Thus refiners have met a −30° F. or lower pour point specification by treatment of naphthenic distillates to such an extent that the term "transformer oil" has been acceptable as meaning refined from a naphthenic distillate. Remarks similar to those just made about transformer oils apply equally well to refrigerator oils, i.e. oils used to lubricate refrigeration compressors.

In recent years techniques have become available for catalytic dewaxing of petroleum stocks. A process of that nature developed by British Petroleum is described in The Oil and Gas Journal dated Jan. 6, 1975, at pages 69-73. See also U.S. Pat. No. 3,668,113.

In U.S. Pat. No. Re. 28,398 is described a process for catalytic dewaxing with a catalyst comprising zeolite ZSM-5. Such process combined with catalytic hydrofinishing is described in U.S. Pat. No. 3,894,938.

SUMMARY OF THE INVENTION

Known unit processes are applied to fractions of waxy crude in particular sequence and within limits to prepare such specialty oils as those used in power transformers and in refrigeration compressors. The first step after preparation of a fraction of suitable boiling range is extraction with a solvent which is selective for aromatic hydrocarbons, e.g. furfural, phenol, or chlorex, to remove undesirable components of the fraction. The raffinate from solvent refining is then catalytically dewaxed in admixture with hydrogen over a catalyst of an aluminosilicate zeolite having a silica to alumina ratio greater than 12 and a constraint index of 1 to 12. Dewaxed oil is hydrotreated to saturate olefins and to reduce product color. Preferably the total effluent from the dewaxer, including hydrogen, is cascaded to the hydrotreater and the reaction product thereafter distilled, i.e. topped by distillation, to separate low boiling products of dewaxing to meet flash and fire point specifications, but the distillation may be conducted inter-stage on the dewaxer effluent.

DESCRIPTION OF SPECIFIC EMBODIMENTS

The wax base crudes (sometimes called "paraffin base") from which the charge stock is derived by distillation constitute a well recognized class of crude petroleums. Many scales have been devised for classification of crude, some of which are described in Chapter VII Evaluation of Oil Stocks of "Petroleum Refinery Engineering", W. L. Nelson, McGraw-Hill, 1941. A convenient scale identified by Nelson at page 69 involves determination of the cloud point of the Bureau of Mines "Key Fraction No. 2" which boils between 527 and 572° F. at 40 mm. pressure. If the cloud point of this fraction is above 5° F., the crude is considered to be wax base, hence unsuited to preparation of transformer oil or refrigerator oil by traditional wisdom.

In practice of the present invention, a fraction having an initial boiling point of at least about 450° F. and a final boiling point less than about 1050° F. is taken by distillation of such wax base crude. That fraction is solvent refined by counter current extraction with at least an equal volume (100 vol.%) of a selective solvent such as furfural. It is preferred to use 1.5 to 2.5 volumes of solvent per volume of oil. The furfural raffinate is subjected to catalytic dewaxing by mixing with hydrogen and contacting at 500°-675° F. with a catalyst containing a hydrogenation metal and zeolite ZSM-5 or other aluminosilicate zeolite having a silica/alumina ratio above 12 and a constraint index of 1-12 and space velocity (LHSV) of 0.1 to 2.0 volumes of charge oil per volume of catalyst per hour. The preferred space velocity is 0.5 to 1.0 LHSV. The effluent of catalytic dewaxing is then cascaded into a hydrotreater containing, as catalyst, a hydrogenation component on a non-acidic support, such as cobalt-molybdate or nickel-molybdate on alumina. The hydrotreater operates at 425° to 600° F., preferably 475° to 550° F., and space velocity like that of the catalytic dewaxing reactor. The reactions are carried out at hydrogen partial pressures of 150-1500 psia, at the reactor inlets, and preferably at 250-500 psia, with 500 to 5000 standard cubic feet of hydrogen per barrel of feed (SCF/B), preferably 1500 to 2500 SCF/B.

The catalytic dewaxing reaction produces olefins which would impair properties of the dewaxed oil product if retained. These are saturated by hydrogenation in the hydrotreater, a reaction evidenced by the temperature rise in the first portion of the hydrotreater, and confirmed by chemical analysis of the feed and hydrotreated product. By this means it is possible to prepare stable good quality transformer or refrigerator oils having pour points below −65° F.

In some instances it may be desirable to partially dewax the charge stock by conventional solvent dewaxing techniques, say to a pour point from 10° F. to about 50° F. The higher melting point waxes so removed are those of greater hardness and higher market value than the waxes removed in taking the product still lower into the range of −30° F. pour point and below.

The cracked (and hydrogenated) fragements from cracking wax molecules in the catalytic dewaxer will have adverse effects on flash and fire points of the product and are therefore removed by distillation of the product to flash and fire point specifications.

The catalyst employed in the catalytic dewaxing reactor and the temperature in that reactor are important to success in obtaining good yields and very low pour point product. The hydrotreater catalyst may be any of the catalysts commercially available for that purpose but the temperature should be held within narrow limits for best results.

The solvent extraction technique is well understood in the art and needs no detailed review here. The severity of extraction is adjusted to composition of the charge stock to meet specifications for specialty oils such as transformer oils and refrigerator oils; this severity will be determined in practice of this invention in accordance with well established practices.

The catalytic dewaxing step is conducted at temperatures of 500° to 675° F. At temperatures above 675° F., bromine number of the product increases significantly and the oxidation stability of the final product after hydrotreating fails to conform to specifications.

The dewaxing catalyst is a composite of hydrogenation metal, preferably a metal of Group VIII of the Periodic Table, associated with the acid form of an aluminosilicate zeolite having a silica/alumina ratio above 12 and a constraint index of 1 to 12.

An important characteristic of the crystal structure of this case of zeolites is that it provides constrained access to, and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The type zeolites useful in this invention freely sorb normal hexane and have a pore dimension greater than about 5 Angstroms. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although, in some instances, excessive puckering or pore blockage may render these zeolites ineffective. Twelve-membered rings do not generally appear to offer sufficient constraint to produce the advantageous conversions, although puckered structures exist such as TMA offretite which is a known effective zeolite. Also, structures can be conceived, due to pore blockage or other cause, that may be operative.

Rather than attempt to judge from crystal structure whether or not a zeolite possesses the necessary constrained access, a simple determination of the "constraint index" may be made by passing continuously a mixture of an equal weight of normal hexane and 3-methylpentane over a small sample, approximately 1 gram or less, of catalyst at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromotgraphy, to determine the fraction remaining unchanged for each of the two hydrocarbons.

The "constraint index" is calculated as follows:

$$\text{Constraint Index} = \frac{\log_{10}}{\log_{10}} \frac{\text{(fraction of n-hexane remaining)}}{\text{(fraction of 3-methylpentane remaining)}}$$

The constraint index approximates the ratio of the cracking rate constants for the two hydrocarbons. Zeolites suitable for the present invention are those having a constraint index in the approximate range of 1 to 12. Constraint Index (CI) values for some typical zeolites are:

| CAS | C.I. |
|---|---|
| ZSM-5 | 8.3 |
| ZSM-11 | 8.7 |
| ZSM-12 | 2 |
| ZSM-38 | 2 |
| ZSM-35 | 4.5 |
| TMA Offretite | 3.7 |
| Beta | 0.6 |
| ZSM-4 | 0.5 |
| H-Zeolon | 0.4 |
| REY | 0.4 |
| Amorphous Silica-Alumina | 0.6 |

-continued

| CAS | C.I. |
|---|---|
| Erionite | 38 |

It is to be realized that the above constraint index values typically characterize the specified zeolites but that such are the cumulative result of several variables used in determination and calculation thereof. Thus, for a given zeolite depending on the temperature employed within the aforenoted range of 550° to 950° F., with accompanying conversion between 10% and 60%, the constraint index may vary within the indicated approximate range of 1 to 12. Likewise, other variables such as the crystal size of the zeolite, the presence of possible occluded contaminants and binders intimately combined with the zeolite may affect the constraint index. It will accordingly be understood by those skilled in the art that the constraint index, as utilized herein, while affording a highly useful means for characterizing the zeolites of interest is approximate, taking into consideration the manner of its determination, with probability, in some instances, of compounding variable extremes. However, in all instances, at a temperature within the above-specified range of 550° F. to 950° F., the constraint index will have a value for any given zeolite of interest herein within the approximate range of 1 to 12.

The class of zeolites defined herein is exemplified by ZSM-5, ZSM-11, ZSM-12, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-38 is more particularly described in U.S. Application Ser. No. 528,060, filed Nov. 29, 1974. This zeolite can be identified, in terms of mole ratios of oxides and in the anhydrous state; as follows:

$$(0.3\text{–}2.5)R_2O : (0\text{–}0.8)M_2) : Al_2O_3 : > 8SiO_2$$

wherein R is an organic nitrogen-containing cation derived from a 2-(hydroxyalkyl) trialkylammonium compound and M is an alkali metal cation, and is characterized by a specified X-ray powder diffraction pattern.

In a preferred synthesized form, the zeolites has a formula, in terms of mole ratios of oxides and in the anhydrous state, as follows:

$$(0.4\text{–}2.5)R_2O : (0\text{–}0.6)M_2O : Al_2O_3 : xSiO_2$$

wherein R is an organic nitrogen-containing cation derived from a 2-(hydroxyalkyl) trialkylammonium compound, wherein alkyl is methyl, ethyl or a combination thereof, M is an alkali metal, especially sodium, and x is from greater than 8 to about 50.

The synthetic ZSM-38 zeolite possesses a definite distinguishing crystalline structure whose X-ray diffraction pattern shows substantially the significant lines set forth in Table I. It is observed that this X-ray diffraction pattern (significant lines) is similar to that of natural ferrierite with a notable exception being that natural ferrierite patterns exhibit a significant line at 11.33Å.

TABLE I

| d (Å) | I/Io |
|---|---|
| 9.8 ± 0.20 | Strong |
| 9.1 ± 0.19 | Medium |
| 8.0 ± 0.16 | Weak |
| 7.1 ± 0.14 | Medium |
| 6.7 ± 0.14 | Medium |
| 6.0 ± 0.12 | Weak |
| 4.37 ± 0.09 | Weak |
| 4.23 ± 0.09 | Weak |
| 4.01 ± 0.08 | Very Strong |
| 3.81 ± 0.08 | Very Strong |
| 3.69 ± 0.07 | Medium |
| 3.57 ± 0.07 | Very Strong |
| 3.51 ± 0.07 | Very Strong |
| 3.34 ± 0.07 | Medium |
| 3.17 ± 0.06 | Strong |
| 3.08 ± 0.06 | Medium |
| 3.00 ± 0.06 | Weak |
| 2.92 ± 0.06 | Medium |
| 2.73 ± 0.06 | Weak |
| 2.66 ± 0.05 | Weak |
| 2.60 ± 0.05 | Weak |
| 2.49 ± 0.05 | Weak |

A further characteristic of ZSM-38 is its sorptive capacity providing said zeolite to have increased capacity for 2-methylpentane (with respect to n-hexane sorption by the ratio n-hexane/2-methyl-pentane) when compared with a hydrogen form of natural ferrierite resulting from calcination of an ammonium exchanged form. The characteristic sorption ratio n-hexane/2-methylpentane for ZSM-38 (after calcination at 600° C.) is less than 10, whereas that ratio for the natural ferrierite is substantially greater than 10, for example, as high as 34 or higher.

Zeolite ZSM-38 can be suitably prepared by preparing a solution containing sources of an alkali metal oxide, preferably sodium oxide, an organic nitrogen-containing oxide, an oxide of aluminum, an oxide of silicon and water and having a composition, in terms of mole ratios of oxides, falling within the following ranges:

| | Broad | Preferred |
|---|---|---|
| $R^+/R^+ + M^+)$ | 0.2–1.0 | 0.3–0.9 |
| $OH^-/SiO_2$ | 0.05–0.05 | 0.07–0.49 |
| $H_2O/OH^-$ | 41–500 | 100–250 |
| $SiO_2/Al_2O_3$ | 8.8–200 | 12–60 |

wherein R is an organic nitrogen-containing cation derived from a 2-(hydroxyalkyl) trialkylammonium compound and M is an alkali metal ion, and maintaining the mixture until crystals of the zeolite are formed. (The quantity of $OH^-$ is calculated only from the inorganic sources of alkali without any organic base contribution). Thereafter, the crystals are separated from the liquid and recovered. Typical reaction conditions consist of heating the foregoing reaction mixture to a temperature of from about 90° C. to about 400° C. for a period of time of from about 6 hours to about 100 days. A more preferred temperature range is from about 150° C. to about 400° C. with the amount of time at a temperature in such range being from about 6 hours to about 80 days.

The digestion of the gel particles is carried out until crystals form. The solid product is separated from the reaction medium, as by cooling the whole to room temperature, filtering and water washing. The crystalline product is thereafter dried, e.g. at 230° F. for from about 8 to 24 hours.

Zeolite ZSM-35 is particularly described in U.S. Pat. No. 4,016,245, dated Apr. 5, 1977.

The specific zeolites described, when prepared in the presence of organic cations, are catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special type of zeolite. More generally, it is desirable to activate this type catalyst by base exchange with ammonium salts followed by calcination in air at about 1000° F. for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-38 and ZSM-35, with ZSM-5 particularly preferred.

In a preferred aspect of this invention, the zeolites hereof are selected as those having a crystal framework density, in the dry hydrogen form, of not substantially below about 1.6 grams per cubic centimeter. It has been found that zeolites which satisfy all three of these criteria are most desired. Therefore, the preferred zeolites of this invention are those having a constraint index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, is important as the locus of catalytic activity.

Crystal framework densities of some typical zeolites are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |

-continued

| Zeolite | Void Volume | Framework Density |
|---|---|---|
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IB to VIII of the Periodic Table, including, by way of example, nickel, copper, zinc, palladium, calcium or rare earth metals.

In practicing the desired conversion process, it may be desirable to incorporate the above described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral consistuent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix may vary widely with the zeolite content ranging from between about 1 to about 99 percent by weight and more usually in the range of about 5 to about 80 percent by weight of the composite.

Preferably, the effluent of the catalytic dewaxing step, including the hydrogen, is cascaded into a hydrotreating reactor of the type now generally employed for finishing of lubricating oil stocks. The distillation necessary to remove light products for conformance to fire and flash point specifications may be conducted between the dewaxing and hydrotreating steps. However, since there are indications that inter-stage distillation and/or storage results in less stable product, and also to avoid need for separation and recharging of hydrogen with intermediate distillation, cascade type operation is preferred.

Any of the known hydrotreating catalysts consisting of a hydrogenation component on a non-acidic support may be employed, for example cobalt-molybdate, or nickel-molybdate, or molybdenum oxide, on an alumina support. Here again, temperature control is required for production of high quality product, the hydrotreater being preferably held at 475°-550° F.

When the preferred cascade configuration is used, the effluent of the hydrotreater is topped by distillation, i.e. the most volatile components are removed, to meet flash and fire point specifications.

EXAMPLE 1

Transformer oil conforming to accepted specifications was prepared from Arabian Light Crude by vacuum distillation of atmospheric bottoms. Properties of that fraction are shown in Table II. The distillate was extracted with 150 vol.% of furfural with extraction column top and bottom temperatures of 149° F. and 131° F., respectively. Raffinate yield was 64.5 vol.% of distillate charged to extractor. Properties of raffinate are shown in Table II for composites of drum lots. The preparation to this point was done in commercial units. Raffinate #1 is composite of the first 18 drums charged to the dewaxing and hydrotreating presently to be described. Raffinate #2 is composite of an additional 20 drums so charged.

TABLE II

Properties of Arabian Light Distillate and Furfural Raffinate

| | Distillate | Raffinate #1 | Raffinate #2 |
|---|---|---|---|
| Gravity, ° API | 27.4 | 36.8 | 36.8 |
| Gravity, Specific at 60° F. | 0.8905 | 0.8408 | 0.8408 |
| Pour Point, ° F, | 45 | 55 | 50 |
| Flash Point, ° F. (C.O.C.) | 335 | 340 | 345 |
| KV at 100° F. Centistokes. | 9.53 | 8.49 | 8.41 |
| KV at 210° F. Centistokes | 2.41 | 2.36 | 2.37 |
| SUS at 100° F. Seconds | 57.2 | 53.7 | 53.4 |
| SUS at 210° F. Seconds | 34.2 | 34.0 | 34.1 |
| Neutralization No. Mg. KOH/gm | 0.05 | 0.04 | 0.08 |
| Sulfur, % wt. | 2.31 | 0.5/0.52 | 0.528 |
| Nitrogen, % wt. | 0.04 | 0.0017 | 0.0012 |
| Refractive Index at 20° C. | | 1.46588 | 1.46566 |
| Refractive Index at 70° C. | 1.47881 | | |
| Aniline Point, ° F. | 158.2 | 194.9 | 195.5 |
| Distillation (D-2887) | | | |
| IBP, ° F. | 480 | 502 | 477 |
| 5% | 559 | 561 | 563 |
| 10% | 592 | 595 | 595 |
| 30% | 647 | 652 | 652 |
| 50% | 681 | 679 | 684 |
| 70% | 706 | 703 | 710 |
| 90% | 733 | 730 | 736 |
| 95% | 742 | 740 | 744 |
| EP | —* | 783 | 774 |

*Value for EP not reported since it was deemed clearly erroneous.

The raffinate was catalytically dewaxed over NiHZSM-5, i.e. nickel exchanged zeolite ZSM-5 which had been converted to the hydrogen form by base exchange with ammonium chloride and calcining. Temperature in catalytic dewaxing was raised from an initial temperature of 550° F. to 615° F. at end of the 12 day run; the increase was 5° to 5.5° F. per day, to maintain constant product pour point. Pure hydrogen was supplied with the charge raffinate at the rate of 2500 SCF/B. The hydrodewaxer effluent was cascaded to a hydrotreater charged with cobalt molybdate on alumina maintained at 475° F. Pressure in both units was 400 psig and space velocity in each was about 1 LHSV based on raffinate charge.

Desulfurization during a material balance on running drum No. 18 was found to be 38.4 weight % at a period when hydrodewaxer temperature was 585° F., and transformer oil product had a pour point of −45° F. In that material balance, the conversion product was found to yield 2.5 weight % dry gas based on charge (propane and lighter), 9.7 weight % $C_4$'s and $C_5$'s and 0.2 weight % hydrogen sulfide. The $C_4$–$C_5$ fraction included 0.2 weight % each, based on charge, of butenes and pentenes. Hydrogen consumption was 131 SCF/bbl of raffinate charge. The balance of the product for drum No. 18, based on charge, was:

| | |
|---|---|
| 125 - 330° F. naphtha | 11.2 wt. % |
| 330 - 510° F. gas oil | 5.1 |
| 510° + Transformer Oil | 71.8 |

Properties of the 510° F. initial boiling point transformer oil fraction are well within accepted specifications as shown in Table III, wherein are reported the physical and other properties of the topped material prepared from the combined runs of all 38 drums.

TABLE III

Arabian Light Crude Derived Catalytic Dewaxed/Hydrotreated Transformer Oil Versus Typical Industry Specification

| Physical Properties | Transformer Oil | Specification |
|---|---|---|
| Gravity, Specific at 60 | 0.8565 | .91 max |
| Pour Point, ° F | −60 | −40 max |
| Cloud Point, ° F. | −46 | |
| Flash Point, COC, ° F. | 340 | 295 min |
| Flash Point, PMCC, ° F. | 345 | |
| Fire Point, COC, ° F. | 360 | |
| Aniline Point, ° F. | 185.4 | |
| Color, ASTM | Lt ¼ | |
| KV at −22° F., cs. | 634.3 | |
| KV at 32° F. (0° C.) cs. | 58.52 | 76 max |
| KV at 100° F., cs. | 10.61 | 13.0 max |
| KV at 210° F., cs. | 2.59 | 3.1 max |
| Refractive Index at 20° C. | 1.47338 | |
| Neutralization No. Mg KOH/gr | 0.0 | |
| Interfacial Tension, Dynes/cm | 48.5 | 40 min |
| Nitrogen, ppm | 12 | |
| Sulfur, % wt. | 0.29 | |
| Corrosive Sulfur | Pass | |
| Bromine No. | 0.4 | |
| Electrical Properties | | |
| Dielectric Strength, KV | | |
| D-877 | 42 | 30 min |
| D-181 at 0.04" (1mm) Gap | 30 | 28 min |
| Impulse Strength | | |

TABLE III-continued

Arabian Light Crude Derived Catalytic Dewaxed/Hydrotreated Transformer Oil Versus Typical Industry Specification

| Physical Properties | Transformer Oil | Specification |
|---|---|---|
| at 1"Gap, KV | 184 | 145 min |
| Power Factor, % | | |
| at 25° C. | 0.002 | .05 max |
| at 100° C. | 0.044 | .30 max |
| Resistivity, ohm cm | $1.9 \times 10^{13}$ | |
| Oxidation Stability | | |
| 1. ASTM 2440-1, 164-hr test | | |
| % wt. DBPC/sludge/Neut. No. | 0.0 0.11/0.41 0.08/0.30/0.60 max | |
| | 0.31/.027/0.32 0.30/0.20/0.4 max | |
| 2. BS-148 | | |
| % wt. DBPC/sludge/Neut. No. | 0.0/0.07/0.35 0.0/0.10/0.40 max | |

Composition of the product derived by mass spectrometer by chemical type is shown in Table IV.

TABLE IV

Mass Spectrometer Data of Catalytic Dewaxed/Hydrotreated Transformer Oil

| Mass Spectometer Data, % wt. | |
|---|---|
| Paraffins | 30.3 |
| Naphthenes | |
| 1 Ring | 21.5 |
| 2 Ring | 13.2 |
| 3 Ring | 6.0 |
| 4 Ring | 3.3 |
| 5 Ring | 1.1 |
| Total | 45.1 |
| Aromatics | |
| Mono Ring | 19.3 |
| Di-Ring | 1.9 |
| Tri-Ring | 0.6 |
| Tetra Ring | 1.0 |
| Penta + Rings | 0.7 |
| Sulfur Aromatics | 1.1 |
| Total | 24.6 |

Following the run described above, the dewaxing catalyst was reactivated by treatment with pure hydrogen at 900° F. for 24 hours. The activity of the reactivated catalyst was the same as for fresh catalyst.

EXAMPLE 2

This example illustrates the manufacture of refrigeration compressor oil conforming to accepted specifications except for slightly higher viscosity.

A 250 SUS viscosity vacuum distillate fraction was prepared from Arabian Light Crude atmospheric bottoms. The distillate was furfural extracted at 160% vol. furfural and 225° F. and the raffinate was solvent dewaxed to +45° F. pour point using +30° F. filter temperature, 3 to 1 solvent to oil ratio and a 60/40 MEK/-toluene mix. Properties of the distillate, raffinate and +45° F. partially solvent dewaxed raffinate are shown in Table V.

TABLE V

Properties of Arabian Light Distillate, Raffinate and +45° F. Partially Solvent Dewaxed Raffinate

| | Arab Light Distillate | Furfural Raffinate | +45° F Pour Dewaxed Oil |
|---|---|---|---|
| Yield | | | |
| % vol of Crude | 6.7 | 3.0 | 2.6 |
| % vol of Process | 100.0 | 45.3 | 88.2 |
| Product Properties | | | |
| API Gravity | 21.7 | 31.7 | 30.6 |
| Specific Gravity at 60° F | 09236 | 0.8670 | 0.8729 |
| Pour Point, ° F | | 105 | 45 |
| Flash Point, ° F | 475 | | 475 |
| KV at 100° F, cs | | | 48.17 |
| KV at 130° F, cs | 34.77 | 21.77 | |

TABLE V-continued

Properties of Arabian Light Distillate, Raffinate and +45° F. Partially Solvent Dewaxed Raffinate

| | Arab Light Distillate | Furfural Raffinate | +45° F Pour Dewaxed Oil |
|---|---|---|---|
| KV at 210° F, cs | 8.41 | 6.51 | 6.94 |
| SUS at 100° F, sec | | | 224 |
| SUS at 210° F, sec | 53.8 | — | — |
| Neut. No., Mg KOH/g | | <0.02 | <0.02 |
| Bromine Number | | | 1.0 |
| Sulfur, % wt | | 0.57 | 0.60 |
| Nitrogen, ppm | | 22 | 28 |
| Hydrogen, % wt | | 13.44 | 13.50 |
| RI at 20° C | | 1.45722 | 1.47809 |
| RI at 70° C | | — | — |
| Aniline Point, ° F | | 229.5 | 225.5 |
| Furfural, ppm | | 3 | |
| Melting Point, ° F | | | |
| Oil Content, % wt | | | |
| Distillation, ° F (D-2887) | | | |
| IBP | 716 | 718 | 730 |
| 5 | 797 | 777 | 778 |
| 10 | 887 | 796 | 796 |
| 30 | 915 | 840 | 839 |
| 50 | 940 | 872 | 870 |
| 70 | 962 | 902 | 900 |
| 90 | 977 | 943 | 940 |
| 95 | 986 | 961 | 957 |

The +45° F. pour dewaxed oil was catalytic dewaxed to −40° to −50° F. pour. Conditions were 400 psig pressure, 1.0 LHSV, and 575° to 625° F. temperature. Pure hydrogen was supplied with the charge at 2500 $SCFH_2/B$. The catalyst was ZSM-5 catalyst that contained a Group VIII hydrogenation metal. About 100 to 200 SCF of hydrogen were consumed per barrel of feed. The catalyst aged at about 6° F. per day which provides a 12–16 day cycle length to 675° F. end of cycle temperature.

The total catalytic dewaxer effluent was charged to the hydrotreater where it was contacted with a commercial cobalt-moly on alumina catalyst at 400 p.s.i.g., 475° F., and 2500 SCF $H_2/B$ at 1.0 LHSV based on oil charged to the catalytic dewaxer unit. Hydrogen consumption was about 100–200 SCF/B.

The above method in which the total effluent from the catalytic dewaxer is passed through the hydrotreater without intermediate storage and/or distillation is referred to herein as "cascading".

The hydrotreated, catalytic dewaxed oil was stripped with nitrogen and redistilled (i.e. topped) to about 670° F. to eliminate residual light material and bring the final product to specification flash point.

Properties of the refrigerator oil produced by the above process is given in Table VI.

TABLE VI

Properties of Refrigerator Oil from Paraffinic Crude and Typical Industry Specification

| | Finished Oil | Specification |
|---|---|---|
| Yield, % vol Crude | 4.7 | — |
| Yield, % vol Raffinate | 69.5 | — |
| Product Properties | | |
| API Gravity | 27.8 | — |
| Specific Gravity at 60° F | 0.8883 | — |
| Pour Point, ° F | −50 | −29 |
| Flash Point, ° F | 460 | 374 |
| KV at 100° F, cs | 79.27 | 58.1/71.2 |
| KV at 210° F, cs | 8.40 | — |
| SUS at 100° F, sec | 368 | 270/330 |
| SUS at 210° F, sec | 53.7 | — |
| ASTM Color | L-¼ | — |
| Neut. No., Mg KOH/g | 0.03 | 0.05 max |
| Sulfur, % wt | 0.54 | — |
| Nitrogen, ppm wt | 15 | — |
| RI at 20° C | 1.48562 | — |
| Aniline Point, ° F | 214.5 | — |
| Bromine Number | 1.0 | — |

TABLE VI-continued

| Properties of Refrigerator Oil from Paraffinic Crude and Typical Industry Specification | Finished Oil | Specification |
|---|---|---|
| Hydrogen, % wt | 13.00 | — |
| Water, ppm | 7 | 40 max. |
| Freon Floc, ° F (F-12) | −119 | −40 max. |
| Cu Strip, 3 Hr at 250° F | — | No stain |
| Corrosive Sulfur | None | None |
| Distillation, °F (D-2887) | | |
| IBP | 662 | — |
| 5,% | 757 | — |
| 10 % | 783 | — |
| 30 % | 832 | — |
| 50 % | 865 | — |
| 70 % | 897 | — |
| 90 % | 939 | — |
| 95 % | 957 | — |
| EP % | 1012 | — |

We claim:

1. A process for preparing high quality specialty oil from waxy crude oil which comprises separating from said waxy crude a distillate fraction thereof having an initial boiling point of at least about 450° F. and a final boiling point less than about 1050° F., extracting said distillate fraction with a solvent selective for aromatic hydrocarbons to yield a raffinate from which undesirable compounds have been removed, catalytically dewaxing the raffinate in the presence of hydrogen to a pour point not higher than about −30° F. by contacting said raffinate at a temperature of 500° to 675° F. with a dewaxing catalyst comprising an aluminosilicate zeolite having a silica/alumina ratio above 12 and a constraint index between 1 and 12 thereby forming dewaxed raffinate and lower boiling hydrocarbons, hydrotreating the dewaxed raffinate by contact at a temperature of 425° to 600° F. with a hydrotreating catalyst comprising a hydrogenation component on a non-acidic support, and topping the raffinate subsequent to dewaxing to remove therefrom said lower boiling hydrocarbons, whereby directly recovering substantially all of the remainder of said dewaxed raffinate, said remainder having a pour point not higher than about −30° F.

2. A process according to claim 1 wherein said dewaxing catalyst comprising an aluminosilicate zeolite comprises ZSM-5 and a hydrogenation metal.

3. A process according to claim 1 wherein the effluent of said catalytic dewaxing step is cascaded to the hydrotreating step.

4. A process according to claim 2 wherein the effluent of said catalytic dewaxing step is cascaded to the hydrotreating step.

5. A process according to claim 1 wherein said topping of dewaxed raffinate is conducted between the catalytic dewaxing and the hydrotreating step.

6. A process according to claim 2 wherein said topping of dewaxed raffinate is conducted between the catalytic dewaxing and the hydrotreating step.

7. A process according to claim 1 wherein said raffinate is partially dewaxed by solvent dewaxing before said catalytic dewaxing step.

8. A process according to claim 2 wherein said raffinate is partially dewaxed by solvent dewaxing before said catalytic dewaxing step.

9. A process according to claim 2 wherein said raffinate is partially dewaxed by solvent dewaxing before the catalytic dewaxing step, and the effluent of said catalytic dewaxing step is cascaded to the hydrotreating step.

10. The process described in claim 9 wherein said topping of dewaxed raffinate is conducted between the catalytic dewaxing step and the hydrotreating step.

11. A process according to claim 2 wherein said raffinate is catalytically dewaxed to a pour point not higher than about −40° F., and wherein said remainder of said directly recovered dewaxed raffinate has a pour point of not higher than about −40° F.

* * * * *